United States Patent [19]

Nakano et al.

[11] Patent Number: 4,482,003

[45] Date of Patent: Nov. 13, 1984

[54] METHOD FOR CONTINUOUS CASTING OF STEEL

[75] Inventors: Taketo Nakano; Masao Fuji, both of Sagamihara; Shozo Mizoguchi, Oita, all of Japan

[73] Assignee: Nippon Steel Corporation, Tokyo, Japan

[21] Appl. No.: 368,446

[22] Filed: Apr. 14, 1982

[30] Foreign Application Priority Data

Apr. 28, 1981 [JP] Japan ..... 56-63266

[51] Int. Cl.[3] ..... B22D 11/16

[52] U.S. Cl. ..... 164/452; 164/472; 164/473

[58] Field of Search ..... 164/56.1, 155, 413, 164/416, 452–454, 472–473, 478

[56] References Cited

U.S. PATENT DOCUMENTS 2,376,518 5/1945 Spence ..... 164/472

3,620,290 11/1971 Kress et al. ..... 164/472

4,162,699 7/1979 Mairy ..... 164/472

FOREIGN PATENT DOCUMENTS 56-47244 4/1981 Japan ..... 164/452

*Primary Examiner*—Kuang Y. Lin

*Assistant Examiner*—Richard K. Seidel

*Attorney, Agent, or Firm*—Wenderoth, Lind & Ponack

[57] ABSTRACT

In a method for continuous casting of steel, an improvement which is constituted by carrying out the continuous casting process while the thickness of a molten mold powder pool adjacent to the molten steel melt within a continuous casting mold is maintained at a desired preset value, and whenever the actual value deviates from the preset value, the continuous casting can still be continued by adjusting the casting conditions or by selecting a powder appropriate for the casting conditions. The method produces a casting requiring no subsequent processing to remove defects.

4 Claims, 5 Drawing Figures

METHOD FOR CONTINUOUS CASTING OF STEEL

BACKGROUND OF THE INVENTION

1. Field of the Invention

The present invention relates to a method for continuous casting of steel using a mold powder applied to a continuous casting mold.

2. Description of the Prior Art

In the continuous casting of steel, a mold powder for the continuous casting mold (referred to "powder" hereinafter) is added adjacent to the steel melt in the mold, and functions to cover the surface of the melt so as to make it retain heat and prevent it from oxidizing. Moreover, the powder is fused by the heat of the hot melt and finds its way into the gap between the inner wall of the mold and the casting where it acts as a lubricant. In addition, the mold is oscillated vertically to prevent sticking between the mold and the casting.

When the properties of the powder material which determine its heat retention, oxidization prevention and lubrication characteristics or other properties of the melting process and the molten-state properties thereof are improper, or the oscillation conditions are improper, various defects, such as surface cracks and slag inclusion occur on the surface of the casting. Consequently, the amount of scarfing required is greatly increased, lowering the production yield, increasing the cost and degrading the quality of the final steel product.

Accordingly, much research has been directed toward optimizing the various properties of the powder and numerous patent applications have been filed on the improvements achieved. In addition, as a matter of fact, many efforts have been made by research engineers at the point of production toward improvement of the vertical oscillation conditions of the mold.

However, the level of the art has still not advanced to the point where a defect-free casting requiring no further processing can be produced. Currently, it is still necessary to subject the whole surface of the casting to auto-scarfing to remove several mm of the skin of the casting, or to partially scarf the surface manually. As the temperature of the casting falls considerably during scarfing, there is a large loss of thermal energy.

More particularly, with increasing casting speed there is an increase both in the occurrence of defects during casting and in the occurrence of trouble such as breakout (caused by molten steel flowing out from the casting) which make it necessary to suspend the continuous casting operation. Because of these problems, the casting speed is restricted.

Quite recently, in order to save energy, increase yield, reduce cost and raise productivity, there has come to be desired technology making it possible to directly charge a hot casting emerging from the continuous casting machine into a heating furnace or to deliver it directly to a rolling machine. For this, it is necessary to be able to produce a steel casting which does not require scarfing or other conditioning treatment.

However, the production of such a casting has up to now been very difficult because the efforts toward improvement have been made separately for the powder and the mold operating conditions.

SUMMARY OF THE INVENTION

The present invention provides a method for continuous casting of steel capable of producing a casting requiring no subsequent processing for the removal of surface defects or the like. The ability of the method to produce such a casting is based on its optimization both of such operational factors as casting withdrawal speed and mold oscillation conditions and of the powder properties.

Accordingly, it is a principal object of the present invention to provide a method for continuous casting of steel which prevents the occurrence of longitudinal cracks in the surface of the casting and produces a casting requiring no subsequent processing to remove defects.

It is another object of the invention to provide a method for continuous casting of steel wherein the thickness of a molten powder pool within the continuous casting mold is maintained at the optimum level for obtaining a steel casting requiring no subsequent processing to remove defects.

It is an additional object of the invention to provide a method for continuous casting of steel wherein the viscosity, in its molten state, of the powder employed is selected in accordance with the casting speed in order to produce a steel casting requiring no subsequent processing to remove defects.

BRIEF DESCRIPTION OF THE DRAWINGS

Other and further objects of the present invention will be better understood from the following detailed description made with reference to the accompanying drawings, in which.

DETAILED DESCRIPTION OF THE INVENTION

Typical casting defects of a continuously cast steel slab which require scarfing and conditioning treatment are longitudinal cracks and skin inclusions. Longitudinal cracks occur locally at portions of the casting where the growth of a solidified shell is delayed. The delay in the local solidification of the shell is caused by the non-uniform inflow of molten powder into the gap between the mold and the casting. In other words, if the occurrence of longitudinal cracks is to be prevented, it is indispensable to avoid non-uniform inflow of the molten powder by assuring the presence of molten powder on the surface of the steel melt at all times. In addition, it is also absolutely indispensable to maintain a supply of molten powder on the surface of the steel melt in order to prevent unmelted or semi-molten powder from being drawn into the melt, and also in order to prevent skin inclusions from forming as in the case where alumina or some other product of the deoxidation reaction is caught in the solidified shell of the casting as it rises to the surface.

Figure 1:
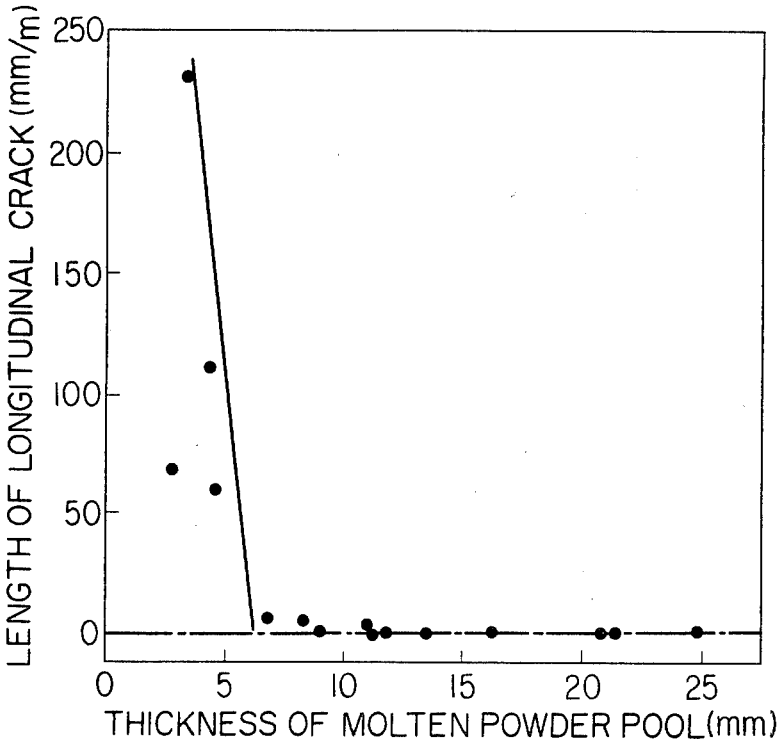
FIG. 1 is a diagram showing the relationship between the thickness of a molten powder pool on the surface of a steel melt and the occurrence of longitudinal cracks in a steel casting.

FIG. 1 is a diagrammatic view showing the relationship between the thickness P (mm) of a molten powder pool and the occurrence of longitudinal cracks in a steel casting. A 1600 mm×250 mm steel casting was continuously cast under the following casting conditions: casting speed 1.2 m per minute, oscillation frequency of mold 90 cycle per minute, and oscillation stroke of mold 10 mm. It is seen from FIG. 1 that longitudinal cracks can be prevented if the thickness P (mm) of the molten powder pool is maintained so as to be more than 6 mm.

The reason that the thickness of the molten powder pool (referred to "powder pool thickness" hereinafter) has a bearing on the occurrence of longitudinal cracks is considered to be as follows:

In the ordinary continuous casting process, an adhering substance termed "powder rim" or "slag bear" occurs on the inner wall of the mold at the upper portion of the molten powder pool layer. This adhering substance moves up and down as the mold is oscillated, and when the pool thickness is small it comes in touch with the upper end of the solidified shell of steel. The contacting of this adhering substance with the upper end of the solidified shell impedes the inflow of the powder into the gap between the mold and the casting thus causing non-uniform inflow of the molten powder so that longitudinal cracks occur. Therefore, it follows that a thickness greater than a specified thickness of the pool is required in order to prevent the contact of the adhering substance with the upper end of the solidified shell.

Moreover, if the pool thickness becomes extremely small, the solidified shell is so restricted by the mold that it is sometimes ruptured by the pulling force imposed on the solidified shell.

The ruptured portion of the solidified shell gradually moves downwardly together with the movement of the solidified shell, and comes to the lower end of the mold with the result that breakout occurs. The fact that breakout occurs through this mechanism can be ascertained from the fact that a carbon enriched area of a thermal insulator (for instance, carbon) in the unmelted powder occurs on the upper end of the restricted, solidified shell on account of the powder pool thickness being too small.

As described hereinbefore, the adhering substance moves up and down together with the mold oscillation, while the solidified shell moves downwardly at a casting speed V. In addition, the portion of contact between the upper meniscus of the molten steel and the mold fluctuates due to ripple of the surface of the steel melt. Hence the position of formation of the solidified shell, in other words, the position of the upper end of the solidified shell varies. Accordingly, it is considered that the thickness required for the powder pool depends on the relationship among the mold oscillation requirement, casting speed and the rippling of the molten steel.

Based upon the above findings, the inventors of the present invention have found a novel method by which a casting requiring no subsequent processing to remove defects can be produced by carrying out a process for the continuous casting of steel controlled by the relationship represented by the formula (1):

$$P \geqq m - 1000 \times V \times T + a \quad (1)$$

In the above formula, P denotes the thickness (mm) of the molten powder pool, m the distance of descent (mm) of the mold during a negative strip period T (min.) wherein the descending speed of the mold is greater than the withdrawal speed of the casting, V the withdrawal speed of the casting (m/min.), and a the amplitude of the ripples in the molten steel surface in the mold.

The meaning of the formula (1) is explained hereinbelow.

First, consider the case where there is no ripple or undulation of the surface of the molten steel, namely, the ripple amplitude a (mm)=0. In this case, contact between the adhering substance and the upper end of the solidified shell occurs during the descending period of the mold. In general, the negative strip period T (min.) refers to the period during which the descending speed of the mold exceeds the withdrawal speed (casting speed) V (m/min.). The distance between the adhering substance and the upper end of the solidified shell during the descending period of the mold is greatest at the start of the negative strip period and becomes smallest at the finish. In other words, the necessary and sufficient requirement for the occurrence of contact is for the distance between the adhering substance and the solidified shell upper end to be equal to zero at the end of the negative strip period. The greatest distance between the adhering substance and the solidified shell when the above requirement is met corresponds to the smallest thickness of the powder pool required for assuring that no contact occurs between the two.

The first term m (mm) on the right side of the formula (1) is the distance of descent of the adhering substance during the negative strip period T (min.) while the second term $1000 \times V \times T$ (mm) is the distance of descent (mm) of the upper end of the solidified shell during the period T (min.). Therefore, the value of $(m - 1000 \times V \times T)$, namely, the value obtained by subtracting the second term from the first one on the right side of the formula (1) is equal to the greatest distance between the adhering substance and the upper end of the solidified shell under the necessary and sufficient conditions for assuring that the adhering substance will not come in contact with the upper end of the solidified shell. The value thus obtained is equal to the smallest thickness of the powder pool required to prevent the adhering substance from coming in touch with the solidifed shell when no ripple takes place on the surface of the molten steel (namely, in the case a=0).

The above explanation is based on the assumption that no undulation occurs but, in fact some ripples always occur on the surface of the molten steel because of the stream of molten steel discharged from a submerged nozzle and because of the blowing-in of argon gas. Accordingly, it can be considered that the position of upper end of the solidified shell will vary in accordance with the ripple occurring on the molten steel surface. Thus, to prevent the adhering substance from coming in touch with the solidified shell, it is necessary to add the amplitude of undulation to the thickness of the powder pool calculated from the first term and the second term of the formula (1).

To summarize, the right side of the formula (1) indicates the smallest thickness of the powder pool required to prevent the adhering substance from coming in touch with the upper end of the solidified shell. Therefore, with a view to preventing non-uniform inflow of the molten powder and securing an excellent casting of high quality, it is necessary to use a powder having a melting speed sufficient to secure a thickness P (mm) of the molten powder pool greater than the minimum required thickness as determined by the right side of the formula (1). Otherwise, in carrying out the continuous casting process one or more factors among the mold oscillation frequency, oscillation stroke, casting speed, and ripple amplitude of the melt surface must be controlled to maintain the theoretical minimum required thickness of the molten powder pool to less than the actual thickness P (mm) of the powder pool.

The term, "melting speed" of the above-mentioned powder refers to the speed at which the powder is converted to a molten powder by the heat of the molten steel, and a rational index for indicating the speed is the "critical incubation time for heat emission $T_{HC}$" (referred to "$T_{HC}$" hereinafter).

The $T_{HC}$ of a powder is determined as follows: a 30 mm thick layer of the powder is formed on the surface of molten steel melted down by a high frequency induction furnace or the like, and the rate of heat emission Q (Kcal/m$^2$hr) from the surface of the powder layer is measured by a heat flux sensor. At this time, the temperature of the molten steel is preset at the temperature at which the steel would actually be cast using the powder being tested for heat emission quantity. After elapse of a certain time, the heat emission quantity Q (Kcal/m$^2$hr) starts to increase abruptly. The time up to the point when Q starts to increase is defined at $T_{HC}$ (min.). It follows that the melting speed of a powder having a small $T_{HD}$ (min.) is quick while that of a powder having a large one is slow.

The measurement of the thickness P (mm) of the molten powder pool on the left side of the formula (1) is conducted as follows: for instance, a steel wire is inserted perpendicularly as far as the surface of the molten steel through the powder layer within the continuous casting mold, the steel wire is then pulled up, and the length of the wire coated with the molten powder is measured. Any other suitable method can also be used.

The ripple amplitude a (mm) on the right side of the formula (1), can be measured by any several methods two of which are described here. In the first method, a water model is used to simulate the actual stream of molten steel and the surface rippling and the amplitude of rippling measured in this simulation is presumed to equal to that in an actual casting operation. In the second method a floating member made of a refractory material, such as, recrystallized alumina, the density of which is lower than that of the molten steel but higher than that of the powder, is floated on the surface of the molten steel within the continuous casting mold actually being used, to measure the ripple amplitude.

Figure 2:
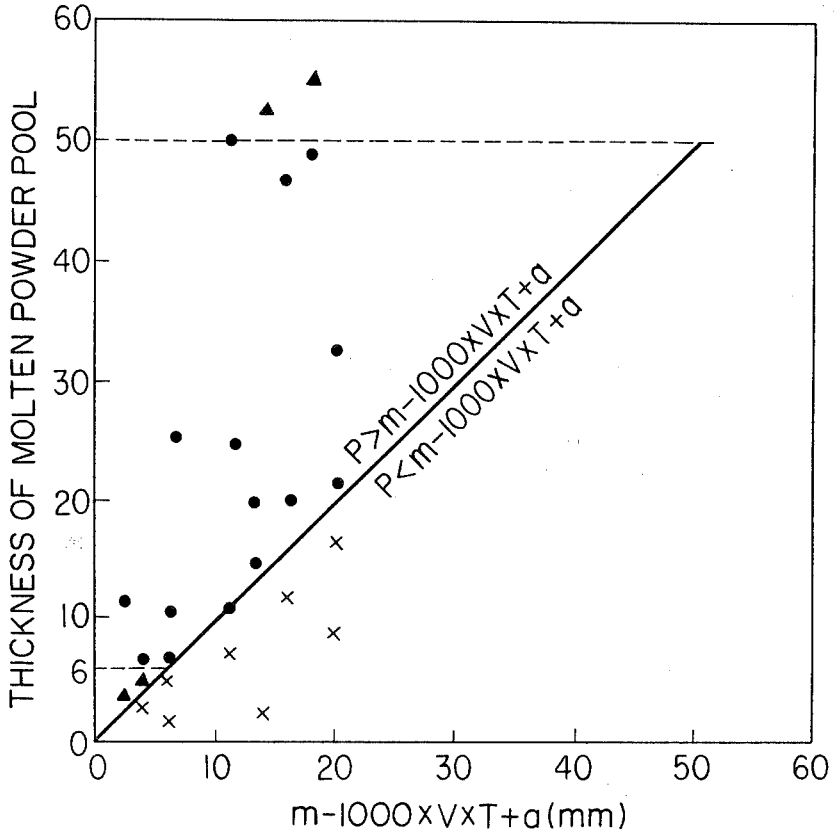
FIG. 2 is a diagram classifying the longitudinal cracks of a casting according to the conditions defined by the formula (1)

FIG. 2 is a graph showing the total length of longitudinal cracks occurring in continuous castings cast under various conditions wherein steel castings in which the total length of longitudinal cracks per one meter of the casting was less than 5 mm are indicated by ●, 5–10 mm by ▮, and more than 100 mm by X. In the graph, the y-axis is gradual for the thickness of the powder pool P (mm) and the x-axis for the minimum required thickness of the pool calculated from the right side of the formula (1) based on the casting conditions and ripple amplitude.

The steel castings were 1600 mm wide and 250 mm thick and were continuously cast at casting speeds of 0.7–1.5 m/min., mold oscillation strokes of 8–15 mm, and solid oscillation frequencies of 80–125 cycles/min.

When a steel casting to be rolled to produce a steel plate has longitudinal cracks of less than 5 mm/m, it will not produce defects in the plate and, therefore, no conditioning treatment of the plate is required. In the production of high quality steel plate, if the longitudinal cracks are in the range of 5–10 mm/m, scarfing is necessary. If the longitudinal cracks amount to more than 100 mm/m, conditioning treatment will be required for all castings regardless of what they are used for.

Almost all continuous steel castings produced under conditions satisfying the formula (1) can be made without being subjected to subsequent processing to remove defects, the only exceptions being those for particularly high quality steel for special purposes. Moreover, the type of mold oscillation used in the present invention is not limited to sine wave oscillation. Cosine, triangular and square wave oscillations can also be used.

Up to this point, the formula (1) has been explained from the viewpoint of powder pool thickness and the occurrence of longitudinal cracks, but the occurrence of skin inclusions in the casting resulting from the inclusion of unmelted powder or the like can be prevented by carrying out the continuous casting process under the conditions of the formula (1). Namely, when the actual thickness P(mm) of the molten powder pool of the left side of the formula (1) is smaller than the theoretical minimum thickness of the powder pool, the adhering substance mentioned hereinbefore causes the unmelted powder to come too near the meniscus of the molten steel so that the unmelted powder penetrates into the meniscus of the molten steel. Also, when the adhering substance comes in contact with the solidified shell, it depresses the solidifed shell toward the molten steel to increase the probability that floating products of the deoxidizing reaction will be caught in the steel casting, with the result that many skin inclusions will occur in the casting.

In order to deal with the case where the actual thickness P (mm) of the molten powder pool in the casting process deviates from the theoretical value obtained from the formula (1), it is preferable to change the casting conditions, namely, to replace the powder in use with another one having a faster melting speed or a smaller $T_{HC}$ (min.) and/or to decrease the frequency of the mold oscillation.

Moreover, if the casting operation is conducted using a thickness P (mm) of the molten powder pool of more than 6 mm, a casting having a much better surface quality can be obtained. On the other hand, if the thickness P (mm) of the molten powder pool exceeds 50 mm, the heat retention effect becomes deficient on account of the presence of unmolten powder on the pool, and an agglomerated substance tends to form on the surface of the molten steel with the result that this agglomerated substance obstructs the inflow of the powder into the gap between the mold and the casting, which results in the formation of defects in the casting. Therefore the thickness P (mm) of the molten powder pool is preferably less than 50 mm.

Furthermore, it is known that the viscosity of the molten powder influences the quality of the casting, particularly the longitudinal cracks thereof, and in general, the greater the withdrawal speed of the casting from the mold the lower the viscosity of the molten powder should be.

However, as described hereinbefore, the clogging of the flow path of the molten powder due to the contact of the adhering substance with the solidified shell formed within the mold constitutes the cause for the non-uniform inflow of the molten powder which in turn is a cause for the occurrence of longitudinal cracks in the casting.

Figure 3:
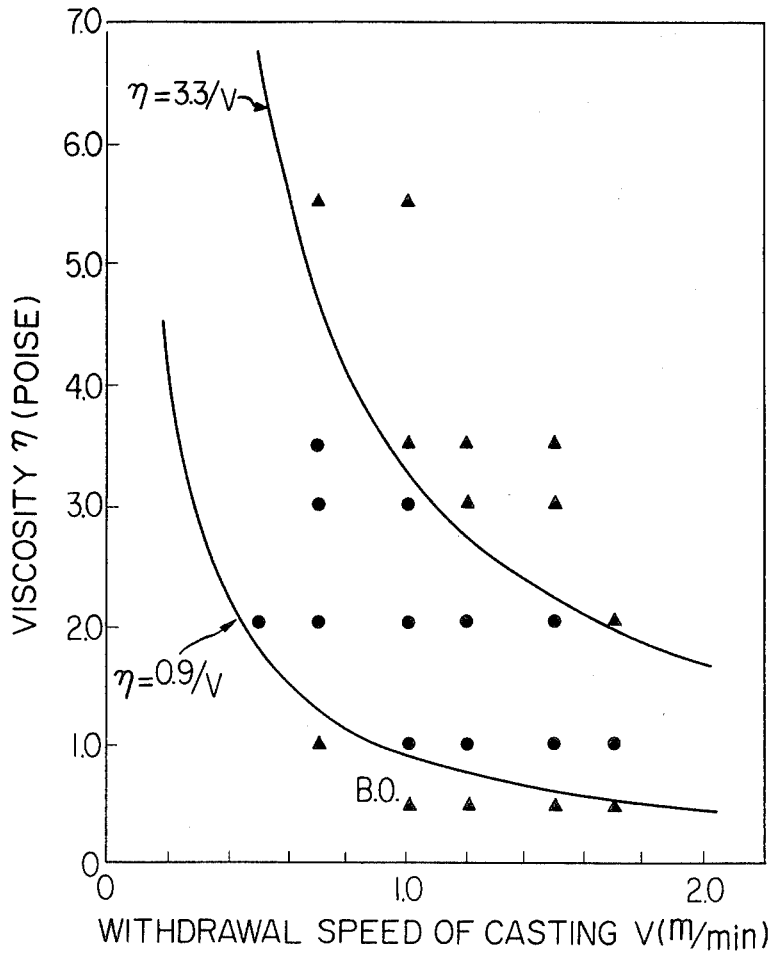
FIG. 3 is a diagram showing the range of viscosity suitable for preventing longitudinal cracks from occurring at various withdrawal speeds of a casting.

Thus, in order to determine the appropriate range of viscosity for the molten powder, the inventors carried out continuous casting using powders having different viscosities in their molten state at 1300° C. The continuous casting was conducted at 1300° C. under conditions satisfying the formula (1), namely, under conditions where no clogging of the flow path of the molten powder occurs at all. The results of the experiment are shown in FIG. 3. In FIG. 3 the y-axis represents the powder viscosity at 1300° C. and the x-axis the withdrawal speed of the casting. Castings having longitudinal cracks totaling less than 5 mm per meter are indiciated by the symbol ● and those having longitudinal cracks totaling 5–10 mm are indicated by the symbol ▌.

It is seen from FIG. 3 that at higher casting speeds, a powder having a low viscosity in its molten state is preferred but that the use of a powder having an extremely low viscosity in its molten state increases the number of longitudinal cracks. Accordingly, use of a powder having a viscosity, in its molten state, in the range represented by the formula (2) is preferred.

$$0.9/V \leqq \eta \leqq 3.3/V \qquad (2)$$

In the formula (2), $\eta$ refers to the viscosity (poise) at 1300° C. and V to the withdrawal speed (m/min.) of the casting.

With regard to the formula (2), when the viscosity is less than 0.9/V, the thickness of the molten powder film which flows into the gap between the mold and the casting becomes so small that the mold comes in contact with the casting so as to give rise to breakout. Beside, the fluidity of the molten powder becomes extremely high and there occurs a local excessive inflow of the molten powder with the result that longitudinal cracks due to non-uniform inflow of the molten powder takes place. If the viscosity exceeds 3.3/V, the molten powder will not flow uniformly into the gap between the mold and the casting, and the fluidity of the molten powder will be so poor that longitudinal cracks will occur.

As seen from the above, a major improvement in casting quality can be attained by casting under conditions satisfying the formula (1). In addition, the production of a casting requiring no subsequent treatment to remove defects can be achieved with a much more desirable result by carrying out the continuous casting process under the conditions of the formula (1) and using a powder with viscosity, in its molten state, falling in the range represented by the formula (2).

As described in the foregoing, the quality of a continuously cast slab or the like can be greatly enhanced by carrying out the continuous casting process in accordance with the present invention wherein the melting characteristics of the powder, the mold oscillation conditions and the thickness of the powder pool within the continuous casting are selected so as to have values exceeding specified values determined on the basis of the casting conditions. Further, a casting having no surface defects whatsoever can be obtained by the combined use of a powder having a viscosity, in its molten state, falling within a specified range determined on the basis of the casting speed. The invention is therefore extremely useful for industry. In the sequence casting process of continuous casting, the present invention is, of course, also very effective.

The effects and advantages of the present invention will be explained in a more concrete manner with reference to the examples hereinbelow.

EXAMPLE 1

Table 1 shows the results obtained in continuously casting a medium carbon aluminum silicon killed steel of the composition consisting of 0.13–0.17%C, 0.3–0.5%Mn, and 0.2–0.25%Si and the remainder Fe at a withdrawal speed 0.7–1.7 m/min. to produce castings 1500–1900 mm in width and 200–280 mm in thickness.

TABLE 1

| No. | V (m/min.) | S (mm) | f (cycle/min.) | a (mm) | (m − 1000 × V × T + a) (mm) | P (mm) | 0.9/V (poise) | 3.3/V (poise) | $\eta_{1300}$ (poise) | Londitudinal cracks (mm/m) | Skin Inclusions (piece/m²) |
|---|---|---|---|---|---|---|---|---|---|---|---|
| Examples of Invention | | | | | | | | | | | |
| 1 | 0.7 | 9 | 100 | 1.0 | 3.0 | 6 | 1.3 | 4.7 | 3.5 | 0.2 | 0.5 |
| 2 | 1.0 | 9 | 100 | 2.0 | 1.0 | 6 | 0.9 | 3.3 | 2.0 | 0.1 | 0.3 |
| 3 | 0.7 | 10 | 80 | 0.0 | 6.0 | 10 | 1.3 | 4.7 | 3.5 | 0.0 | 0.0 |
| 4 | 1.2 | 10 | 90 | 1.6 | 5.8 | 12 | 0.8 | 2.8 | 1.5 | 0.0 | 0.0 |
| 5 | 1.5 | 10 | 125 | 6.2 | 10.9 | 18 | 0.6 | 2.2 | 1.0 | 0.0 | 0.0 |
| 6 | 1.7 | 10 | 125 | 9.2 | 13.4 | 20 | 0.5 | 1.9 | 1.0 | 0.0 | 0.0 |
| 7 | 1.2 | 8 | 90 | 1.5 | 4.0 | 7 | 0.8 | 2.8 | 2.0 | 0.4 | 0.2 |
| 8 | 1.5 | 10 | 125 | 6.2 | 10.9 | 50 | 0.6 | 2.2 | 2.0 | 2.0 | 0 |
| 9 | 1.5 | 10 | 125 | 6.2 | 10.9 | 52 | 0.6 | 2.2 | 2.0 | 6.1 | 0 |
| 10 | 0.7 | 10 | 80 | 0.0 | 6.0 | 8 | 1.3 | 4.7 | 4.0 | 0.3 | 0 |
| 11 | 1.2 | 10 | 90 | 1.6 | 5.8 | 25 | 0.8 | 2.8 | 2.5 | 0 | 0.5 |
| 12 | 1.2 | 10 | 90 | 1.6 | 5.8 | 15 | 0.8 | 2.8 | 1.0 | 0 | 0.4 |
| 13 | 1.5 | 10 | 125 | 6.2 | 10.9 | 30 | 0.6 | 2.2 | 2.0 | 0.5 | 1.5 |
| 14 | 1.5 | 10 | 125 | 6.2 | 10.9 | 41 | 0.6 | 2.2 | 1.0 | 0.6 | 0.6 |
| Examples of Comparison | | | | | | | | | | | |
| 15 | 1.0 | 9 | 100 | 10.0 | 7.0 | 6 | 0.9 | 3.3 | 2.0 | 300.0 | 51.3 |
| 16 | 1.2 | 10 | 90 | 7.0 | 11.2 | 9 | 0.8 | 2.8 | 1.5 | 420.1 | 67.4 |
| 17 | 1.5 | 15 | 125 | 7.5 | 16.8 | 11 | 0.6 | 2.2 | 1.0 | 630.0 | 80.3 |
| 18 | 1.2 | 10 | 90 | 1.6 | 5.8 | 2 | 0.8 | 2.8 | 2.0 | 507.0 | 131.0 |
| 19 | 1.5 | 10 | 125 | 6.2 | 10.9 | 8 | 0.6 | 2.2 | 1.0 | 140.3 | 60.5 |
| 20 | 1.5 | 10 | 125 | 6.2 | 10.9 | 3 | 0.6 | 2.2 | 3.5 | 830.0 | 64.0 |

TABLE 1-continued

| No. | V (m/min.) | S (mm) | f (cycle/min.) | a (mm) | (m − 1000 × V × T + a) (mm) | P (mm) | 0.9/V (poise) | 3.3/V (poise) | $\eta_{1300}$ (poise) | Londitudinal cracks (mm/m) | Skin Inclusions (piece/m$^2$) |
|---|---|---|---|---|---|---|---|---|---|---|---|
| 21 | 1.5 | 10 | 125 | 6.2 | 10.9 | 5 | 0.6 | 2.2 | 0.5 | 780.4 | 11.8 |

Note:
V: casting speed,
S: oscillation stroke,
f: mold oscillation frequency,
a: ripple amplitude of the molten steel surface,
m: mold descending distance during the period in which the mold descending speed becomes faster than the withdrawal speed of the casting,
T: negative strip period where the mold descending speed of mold is faster than the withdrawal speed of the casting,
(m − 1000 × V × T + a): minimum required thickness of the molten powder pool,
P: the thickness of a molten powder of the surface of a molten steel,
0.9/V: lower limit value of the molten powder viscosity at 1300° C. for the casting speed concerned,
3.3/V: upper limit value of the same viscosity at 1300° C.,
$\eta_{1300}$: viscosity of molten powder at 1300° C.

In Table 1, Nos. 1–14 refer to examples of the present invention while Nos. 15–21 are comparative examples.

In examples Nos. 1–2 according to the invention, the mold oscillation was using a triangular wave while in examples Nos. 3–14 according to the invention, the mold was using a cosine wave. In comparative example No. 15 the mold was using a triangular wave, while in comparative examples Nos. 16–21 the mold was using a cosine wave.

In the examples of the invention in which the conditions of the formula (1) were satisifed, it is seen that the occurrence of longitudinal cracks and skin inclusions is greatly reduced, producing castings with much enhanced quality.

In comparative example No. 15 products of the deoxidization reaction such as alumina clogged the submerged nozzle to such an extent that the balance of the flow of molten steel on the right and left was upset and, as a consequence, the ripple amplitude a(mm) of the molten steel became so large that longitudinal cracks and skin inclusions occurred in large numbers. In comparative example No. 16, the amount of argon gas blown from the submerged nozzle was so great that, as in No. 15, the ripple amplitude a(mm) of the molten steel became large, so that the casting quality was considerably deteriorated.

In comparative example No. 17, the mold oscillation was large so that the distance of mold descent m(mm) became excessively large. As a result, the theoretical minimum required thickness of the molten powder pool as expressed by the right side of the formula (1) became so much larger than the actual thickness P(mm) of the molten powder pool that longitudinal cracks and the skin inclusions occurred in large numbers. Namely, Nos. 15–17 are cases where the casting conditions were such that the ripple amplitude a(mm) of the molten steel was too large or the distance of mold descent m(mm) during the negative strip period was excessively great so that the quality of the castings were very poor.

In comparative examples Nos. 18–21, the casting was carried out using a powder having a slow melting speed, i.e. a large $T_{HC}$(min.). As a result, the casting process was carried out under conditions where the left side of the formula (1) was smaller than the right side because the thickness P(mm) of the powder pool was not maintained as large as required. Therefore, longitudinal cracks and skin inclusions occurred frequently.

EXAMPLE 2

Figure 4:
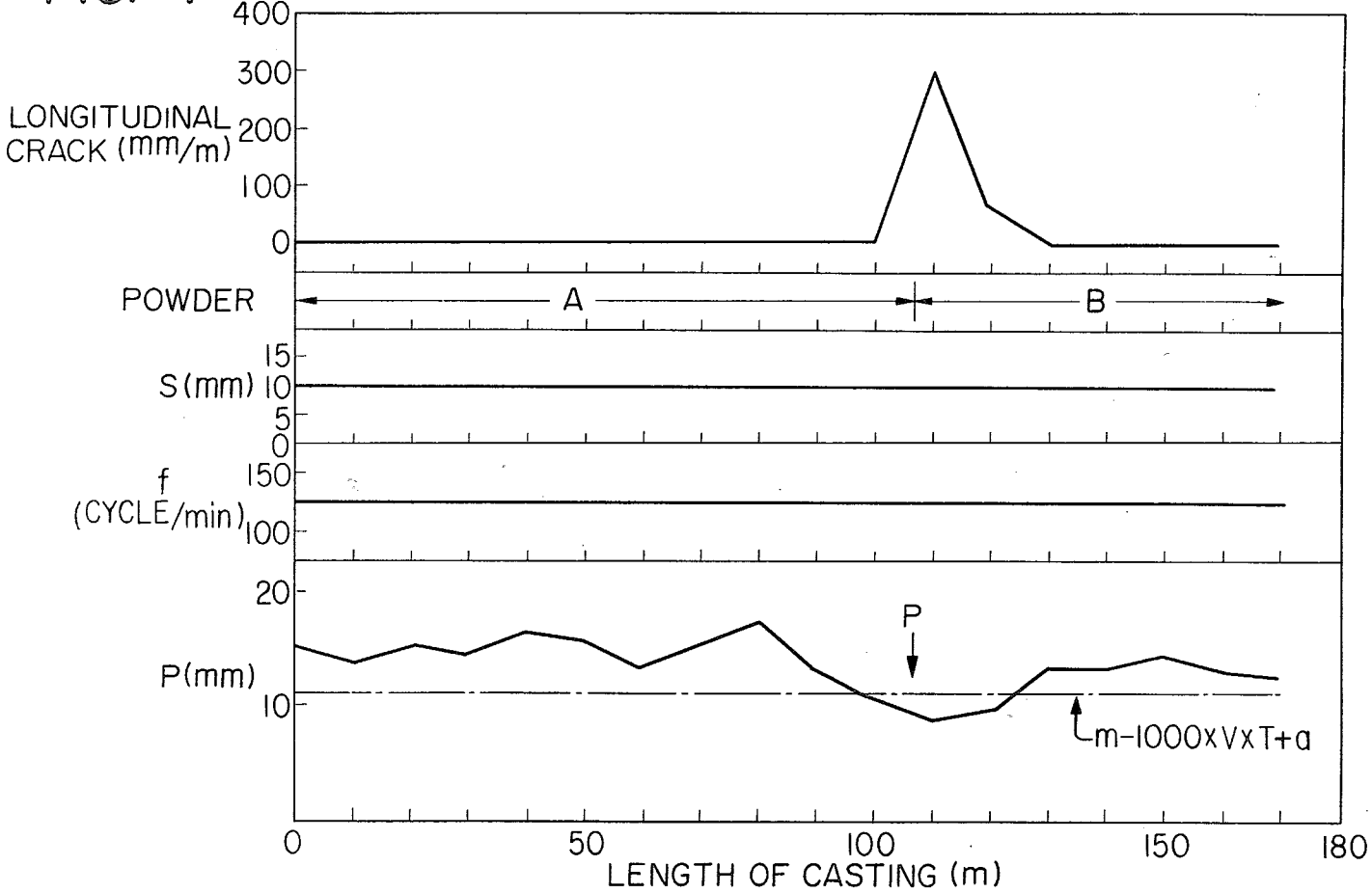
FIG. 4 is a diagram showing the relation between the casting conditions and the occurrence of longitudinal cracks in a casting.
Figure 5:
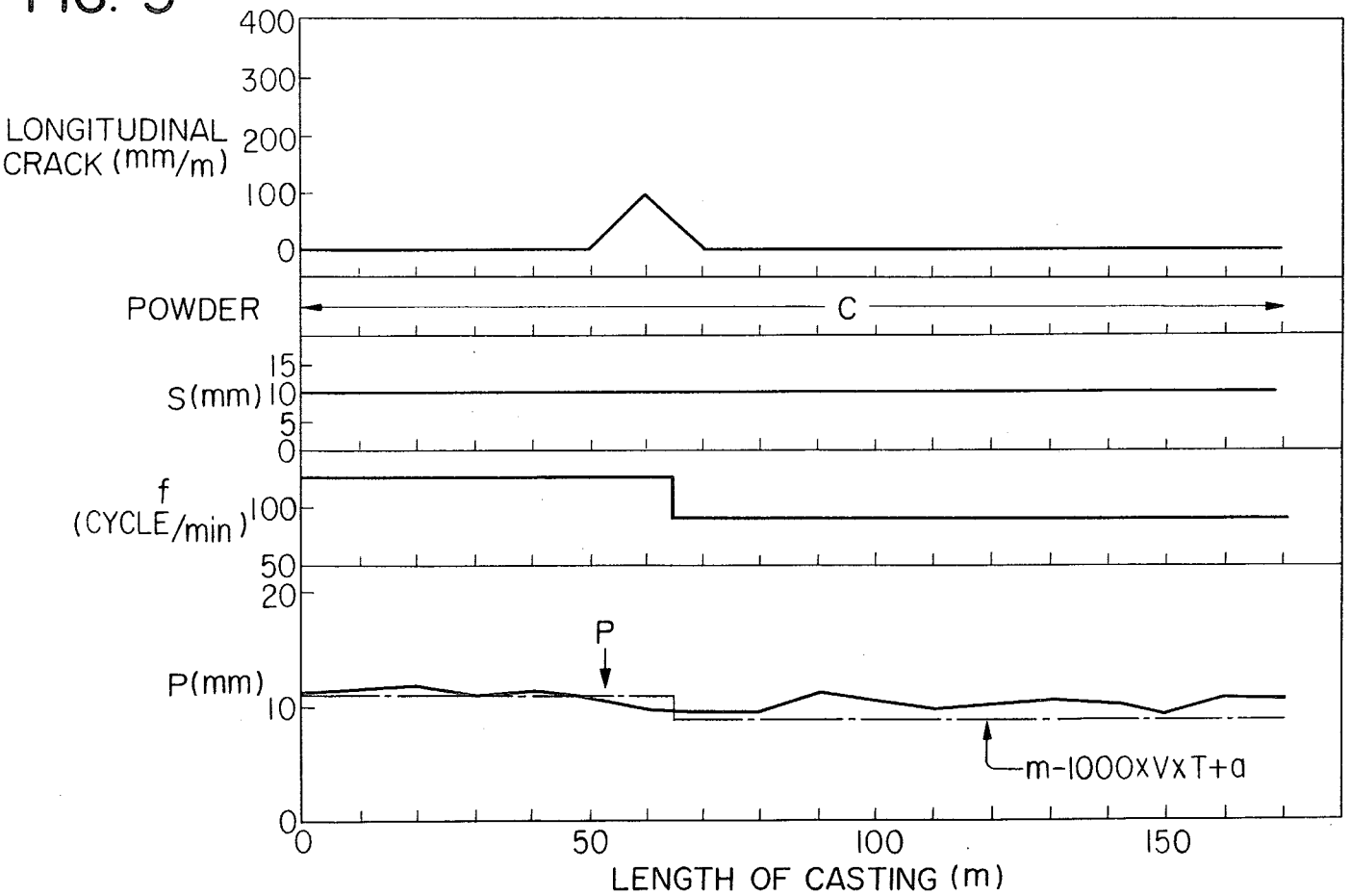
FIG. 5 is another diagram showing the relation between the casting conditions and the occurrence of longitudinal cracks in a casting.

FIGS. 4–5 are graphs showing examples of continuous casting according to this invention.

FIG. 4 shows relation between the casting conditions and the occurrence of longitudinal cracks. A sequence casting process was carried out to produce a 1600×250 mm medium C steel (0.13%C) at a casting speed 1.5 m/min. using a powder A which had a chemical composition consisting chiefly of 34.2%$SiO_2$, 30.8%CaO, 5% $Al_2O_3$, 16%$Na_2O$, and 14%$CaF_2$ in its molten state, a viscosity of 1.2 poise at the temperature of 1300° C. and a $T_{HC}$(min.) of 4 min. The powder A also contained 3.5% carbon black as a thermal insulator. As the temperature of the molten steel decreased during the second charge, the powder fused so poorly that the thickness P(mm) of the molten powder pool became lower than the minimum required thickness according to the right side of the formula (1). The inventors dealt with the situation by changing the kind of powder.

In FIG. 4, when the ladle was replaced by another at a position about 90 m along the length of the casting, the thickness P(mm) of the molten powder pool gradually decreased so much that the conditions of the formula (1) could not be satisfied.

At this time the powder A was replaced by a powder B having the same composition in molten state as the powder A and also the same viscosity at 1300° C. as that of the powder A. However, the powder B contained 2% thermal insulator and had a $T_{HC}$ of 3 min. Thereafter, the thickness P(mm) of the molten powder pool increased so that the casting process would be continued with the thickness of the molten powder pool maintained much larger than the minimum required thickness.

Observation of the casting surface showed that many longitudinal cracks occured on the casting at positions corresponding to 100–120 m of casting length, the region in which the molten powder pool had decreased too much. On the contrary, however, no longitudinal cracks occurred on the casting over a length of 25 m after the powder was changed (P in the drawing). Hence the advantage of the present invention wherein the casting process was carried out in accordance with the relation of the formula (1) was confirmed.

FIG. 5 shows another example showing the relation between the casting and the occurrence of longitudinal cracks. In this example, there was used a powder C having the same chemical composition in its molten state and the same viscosity at 1300° C. as that of the powder A, but containing 4.5% of thermal insulator and having a $T_{HC}$ of 5 min. In the sequence casting process, a 1600×250 mm casting was produced from a medium C steel (0.12%C) at a casting speed of 1.5 m/min. with the use of the powder C. In operation, the casting process was so controlled that the conditions of the formula (1) were satisfied by decreasing the oscillation frequency of the mold, by decreasing the first term m of the right side of the formula (1), and further, by increasing the second term ($1000 \times V \times T$).

At the initiation of the casting process, the thickness of the molten powder pool was at about the same level as the minimum required thickness. At a position where the casting had reached a length of about 5 m, however, the thickness began to fall below the required value.

At this time the oscillation frequency was decreased from 125 cycles/min. to 90 cycles/min., the first term m of the right side of the formula (1) was decreased, the second term ($1000 \times V \times T$) was increased, and minimum required thickness of the molten powder pool was lowered.

On observing the casting thus obtained, it was found that longitudinal cracks occurred on the casting at a position corresponding to the position (P in FIG. 5) where the thickness of the molten powder pool fell to smaller than the minimum required thickness. However, no longitudinal cracks occurred on the casting after the oscillation frequency had been decreased and minimum required thickness of the molten powder pool reduced. Thus, as the example shown in FIG. 4, the effectiveness of the present invention was again confirmed.

We claim:

1. In a method for continuous casting of steel by pouring molten steel into a continuous casting mold, withdrawing the casting downwardly from the mold at a withdrawal speed V in m/min., oscillating said casting mold vertically during the withdrawal, and providing a layer of molten powder on top of the molten steel in the casting mold, the improvement which comprises maintaining the thickness of the molten powder layer according to the formula:

$$P \geqq m - 1000 \times V \times T + a$$

wherein:

P is the thickness in mm of the molten powder layer;

a is the ripple amplitude in mm of any ripples in the surface of the molten steel within said mold;

T is a negative strip period of time in min. during which the speed of descent of the mold is greater than the withdrawal speed V; and m is the distance in mm of descent of said mold during time T.

2. The improvement as claimed in claim 1 in which the powder provided to said mold has a viscosity $\eta$ in its molten state at a temperature of 1300° C. in the range represented by the formula:

$$0.9/V \leqq \eta \leqq 3.3/V$$

3. The improvement as claimed in claim 1 in which, when said thickness of said molten powder layer deviates from said value P, said maintaining step is carried out by substituting a powder having a higher melting speed for the powder in use.

4. The improvement as claimed in claim 1 in which, when said thickness of said molten powder layer deviates from said value P, said maintaining step is carried out by changing at least one of the molding characteristics from among the mold oscillation frequency, the mold oscillation stroke, the casting speed V, and the ripple amplitude.

* * * * *